US008632304B2

(12) United States Patent
Sweetland et al.

(10) Patent No.: US 8,632,304 B2
(45) Date of Patent: Jan. 21, 2014

(54) TURBOCHARGER DIFFUSER

(75) Inventors: Patrick Sweetland, Candler, NC (US); David G. Grabowska, Asheville, NC (US); Aleksandar Sekularac, Rheinland-Pfalz (DE); Stephen I. Roby, Asheville, NC (US)

(73) Assignee: BorgWarner, Auburn Hills, MI (US)

( * ) Notice: Subject to any disclaimer, the term of this patent is extended or adjusted under 35 U.S.C. 154(b) by 951 days.

(21) Appl. No.: 12/664,201

(22) PCT Filed: Jun. 26, 2008

(86) PCT No.: PCT/US2008/068426

§ 371 (c)(1),
(2), (4) Date: Apr. 15, 2010

(87) PCT Pub. No.: WO2009/003140

PCT Pub. Date: Dec. 31, 2008

(65) Prior Publication Data

US 2010/0202877 A1 Aug. 12, 2010

Related U.S. Application Data

(60) Provisional application No. 60/946,199, filed on Jun. 26, 2007, provisional application No. 60/946,221, filed on Jun. 26, 2007.

(51) Int. Cl.
*F01D 5/04* (2006.01)
*F01D 1/08* (2006.01)

(52) U.S. Cl.
USPC ..... 415/204

(58) Field of Classification Search
USPC ..... 415/204, 206, 207
See application file for complete search history.

(56) References Cited

U.S. PATENT DOCUMENTS 5,354,173 A * 10/1994 Reynolds ..... 415/205

FOREIGN PATENT DOCUMENTS

JP 57181999 A 11/1982
JP 2000204908 A 7/2000

OTHER PUBLICATIONS

English translation of Chinese Office Action, dated Mar. 23, 2011.

* cited by examiner

*Primary Examiner* — Dwayne J White
(74) *Attorney, Agent, or Firm* — Miller Canfield

(57) ABSTRACT

A housing (410, 510, 610, 700, 800, 900) for a turbocharger (400, 500, 600) is provided. The housing (410, 510, 610, 700, 800, 900) has an impeller chamber (403, 503, 603), diffuser (450, 550, 650, 750, 850, 950) and scroll (420, 520, 620, 720, 820, 920) in fluid communication with each other. The diffuser (450, 550, 650, 750, 850, 950) can have a curved shape and/or a bend (455) in proximity to a tip (408, 508, 608, 609) of the impeller (405, 505, 605). The curved shape can be defined by one or more radii of curvature ($R_C$, $R_{C1}$, $R_{C2}$). The diffuser (450, 550, 650, 750, 850, 950) can extend in a radial direction that is non-orthogonal to the center line of the turbocharger (400, 500, 600). The housing (410, 510, 610, 700, 800, 900) can be for a compressor section of the turbocharger (400, 500, 600).

11 Claims, 12 Drawing Sheets

TURBOCHARGER DIFFUSER

FIELD OF THE INVENTION

This invention is directed to a turbocharging system for an internal combustion engine and more particularly to a diffuser of a turbocharging system.

BACKGROUND OF THE INVENTION

Turbochargers are a type of forced induction system. They compress the air flowing into an engine, thus boosting the engine's horsepower without significantly increasing weight. Turbochargers use the exhaust flow from the engine to spin a turbine, which in turn drives an air compressor. Since the turbine spins about 30 times faster than most car engines and it is hooked up to the exhaust, the temperature in the turbine is very high. Additionally, due to the resulting high velocity of flow, turbochargers are subjected to noise and vibration. Such conditions can have a detrimental Affect on the components of the turbocharger, particularly on the rotating parts such as the turbine rotor, which can lead to failure of the system.

Turbochargers are widely used on internal combustion engines and, in the past, have been particularly used with large diesel engines, especially for highway trucks and marine applications. More recently, in addition to use in connection with large diesel engines, turbochargers have become popular for use in connection with smaller, passenger car power plants. The use of a turbocharger in passenger car applications permits selection of a power plant that develops the same amount of horsepower from a smaller, lower mass engine. Using a lower mass engine has the desired effect of decreasing the overall weight of the car, increasing sporty performance, and enhancing fuel economy. Moreover, use of a turbocharger permits more complete combustion of the fuel delivered to the engine, thereby reducing the overall emissions of the engine, which contributes to the highly desirable goal of a cleaner environment. The design and function of turbochargers are described in detail in the prior art, for example, U.S. Pat. Nos. 4,705,463, 5,399,064, and 6,164,931, the disclosures of which are incorporated herein by reference.

Turbocharger units typically include a turbine operatively connected to the engine exhaust manifold, a compressor operatively connected to the engine air intake manifold, and a shaft connecting the turbine and compressor so that rotation of the turbine wheel causes rotation of the compressor impeller. The turbine is driven to rotate by the exhaust gas flowing in the exhaust manifold. The compressor impeller is driven to rotate by the turbine, and, as it rotates, it increases the air mass flow rate, airflow density and air pressure delivered to the engine cylinders.

As the use of turbochargers finds greater acceptance in passenger car applications, three design criteria have moved to the forefront. First, the market demands that all components of the power plant of either a passenger car or truck, including the turbocharger, must provide reliable operation for a much longer period than was demanded in the past. That is, while it may have been acceptable in the past to require a major engine overhaul after 80,000-100,000 miles for passenger cars, it is now necessary to design engine components for reliable operation in excess of 200,000 miles of operation. It is now necessary to design engine components in trucks for reliable operation in excess of 1,000,000 miles of operation. This means that extra care must be taken to ensure proper fabrication and cooperation of all supporting devices.

The second design criterion that has moved to the forefront is that the power plant must meet or exceed very strict requirements in the area of minimized $NO_x$ and particulate matter emissions. Third, with the mass production of turbochargers, it is highly desirable to design a turbocharger that meets the above criteria and is comprised of a minimum number of parts. Further, those parts should be easy to manufacture and easy to assemble, in order to provide a cost effective and reliable turbocharger. Due to space within the engine compartment being scarce, it is also desirable that the overall geometric package or envelope of the turbocharger be minimized.

In Japanese Patent Application No. 2000257437A2 to Hiroyuki, a compressor section for a turbocharger is shown which attempts to increase the work load of the pressure conversion by elongating the diffuser. In FIG. 1, an extended diffuser 22 is formed in a compressor housing 18 which is in communication with the compressor impeller 17, the impeller chamber 21 and the scroll 23. The diffuser 22 has an elongated, straight portion 22A extending from the inlet 25A of the diffuser. An end 22B along the outlet portion 25B of the diffuser is bent to provide the fluid communication between the scroll 23 and the diffuser 22.

The Hiroyuki system also suffers from the drawback of requiring a large envelope to account for the length of the diffuser 22. The increased envelope adds cost to the system by requiring more material to be used, such as for compressor housing 18.

U.S. Pat. No. 6,679,057 to Arnold shows a turbocharger with a compressor section having a compressor wheel and movable guide vanes. As shown in FIG. 2, the Arnold system has a turbocharger 110 with a turbine housing 112 adapted to receive exhaust gas from an internal combustion engine and distribute the exhaust gas to an exhaust gas turbine wheel or turbine 114 rotatably disposed within the turbine housing 112 and coupled to one end of a common shaft 116. The turbine housing 112 encloses a variable geometry system that comprises a plurality of pivotably moving vanes 118. A turbine unison ring 119 engages the vanes 118 to effect radially inward and outward movement thereof The turbine unison ring 119 comprises a plurality of slots 120 that correspond with tabs 122, and an elliptical slot 123 that is configured to accommodate placement of an actuator pin 124 therein for purposes of moving the unison ring. The pin 124 is attached to an actuator lever arm 126 and an actuator crank 128 which are disposed within a portion of the turbocharger center housing 130. The actuator crank 128 is rotatably disposed axially through the turbocharger center housing 130, and is configured to move the lever arm 126 back and forth about an actuator crank longitudinal axis, which movement operates to rotate the actuating pin 124 and effect rotation of the unison ring 119 within the turbine housing.

The turbocharger 110 also comprises a compressor housing 131 that is adapted to receive air from an air intake 132 and distribute the air to a compressor impeller 134 rotatably disposed within the compressor housing 131 and coupled to an opposite end of the common shaft 116. The compressor housing 131 also encloses a variable geometry member 136 interposed between the compressor impeller 134 and an air outlet. The variable geometry member 136 is positioned in a straight, radial diffuser 175 and comprises a plurality of pivoting vanes 138. The diffuser 175 is connected with volute 180, which is formed along an outer region and radially remote from the impeller 134.

A compressor unison ring 140 is rotatably disposed within the compressor housing 131 and is configured to engage and rotatably move all of the compressor vanes 138 in unison. The compressor unison ring 140 comprises a plurality of slots 142 that correspond with tabs 144 projecting from each respective compressor vane. The compressor adjustment ring 140 comprises a slot and an actuating pin 146 that is rotatably disposed within the slot. An actuating lever arm 148 is attached to the actuating pin 146 and to the actuator crank 128. The actuating pin 146 and lever arm 148 are disposed through a backing plate 150 that is interposed between the turbocharger compressor housing 131 and the center housing 130. Rotation of the actuating pin 146 causes the compressor unison ring 140 to rotate along the backing plate 150.

The Arnold system suffers from the drawback of requiring a large envelope to account for the length of the diffuser 175 and the moveable guide vanes 138 positioned therein. The increased envelope adds cost to the system by requiring more material to be used, such as for the compressor housing 131.

In FIG. 3, a portion of a contemporary compressor housing 200 is shown having a scroll 220 and a flat radial diffuser 250. Diffuser 250 lies along diffuser plane $P_{FD}$, which is formed along an outer circumference of the scroll 220. To increase the diffuser length, the contemporary turbocharger requires that the geometric envelope of the turbocharger be increased. The increased envelope adds cost to the system by requiring more material to be used, such as for a compressor housing.

Thus, there is a need for a turbocharger system, and method of manufacturing such a system, that effectively and efficiently controls fluid flow from the compressor wheel. There is a further need for such a system that maximizes diffusion without increasing the size of the geometric envelope. There is yet a further need for such a system and method of manufacturing such a system that is reliable and cost-effective.

SUMMARY OF THE INVENTION

The exemplary embodiments of the turbocharger diffuse fluid over a desired length of a diffuser while maintaining the geometric package or envelope. The diffuser can have a curved shape or other bend to maintain the desired length for diffusing and/or to allow low momentum flow to accelerate to a velocity substantially the same as the rest of the flow. Increasing the length of the diffuser provides more and/or slower diffusion of the fluid, which increases efficiency and/or stability in compressing the fluid.

In one aspect of the invention, a housing for a turbocharger having an impeller is provided. The housing comprises an impeller chamber rotatably housing the impeller; a scroll; and a diffuser having an inlet in proximity to the impeller and an outlet connected to the scroll. The impeller chamber, diffuser and scroll are in fluid communication, and the inlet has a curved shape.

In another aspect, a turbocharger is provided comprising an impeller; and a housing defining an impeller chamber, a diffuser and a scroll. The impeller is rotatably mounted in the housing. The impeller chamber, diffuser and scroll are in fluid communication, and the diffuser extends radially outward in a direction that is non-orthogonal to a center line of the turbocharger.

In another aspect, a method of manufacturing a turbocharger is provided. The method comprises providing a compressor housing having a scroll, a diffuser and an impeller chamber in fluid communication with each other; determining a velocity profile in the diffuser for fluid flow driven by an impeller rotatably mounted in the compressor housing; and forming a bend in the diffuser if the velocity profile is non-uniform.

The exemplary embodiments of the turbocharger diffuse fluid over a sufficient length of a diffuser while providing a reduced geometric package or envelope. The diffuser can have a curved shape or path to maintain the sufficient length for diffusing and/or the inlet of the diffuser can be radially outward of the inner circumference of the scroll. The scroll can be moved closer to the impeller chamber while positioned axially farther from the impeller to maintain the diffuser length and take advantage of unused space within the geometric envelope.

In one aspect of the invention, a housing for a turbocharger having an impeller is provided. The housing has a body rotatably housing the impeller and defining an impeller chamber, a diffuser and a scroll. The impeller chamber, diffuser and scroll are in fluid communication, and the diffuser has a curved path or shape.

In another aspect, a turbocharger is provided comprising an impeller; and a housing defining an impeller chamber, a diffuser and a scroll. The impeller is rotatably mounted in the housing, and the impeller chamber, diffuser and scroll are in fluid communication. The diffuser has an inlet radially outward of an inner circumference of the scroll.

In another aspect, a method of manufacturing a turbocharger is provided. The method comprises faulting a compressor housing defining an impeller chamber, a diffuser and a scroll; and rotatably mounting an impeller in the compressor housing to compress and deliver a fluid through the diffuser and scroll to an internal combustion engine. The impeller chamber, diffuser and scroll are in fluid communication, and the diffuser has a curved path.

BRIEF DESCRIPTION OF THE DRAWINGS

The present invention is illustrated by way of example and not limitation in the accompanying drawings in which like reference numbers indicate similar parts, and in which.

DETAILED DESCRIPTION OF THE INVENTION

Embodiments of the invention are directed to diffusion in a turbocharger for delivery of a compressed fluid to an internal combustion engine. Aspects of the invention will be explained in connection with a compressor section having a particular diffuser and scroll, but the detailed description is intended only as exemplary. Exemplary embodiments of the invention are shown in FIGS. 4-9, but the present invention is not limited to the illustrated structure or application.

Figure 4:
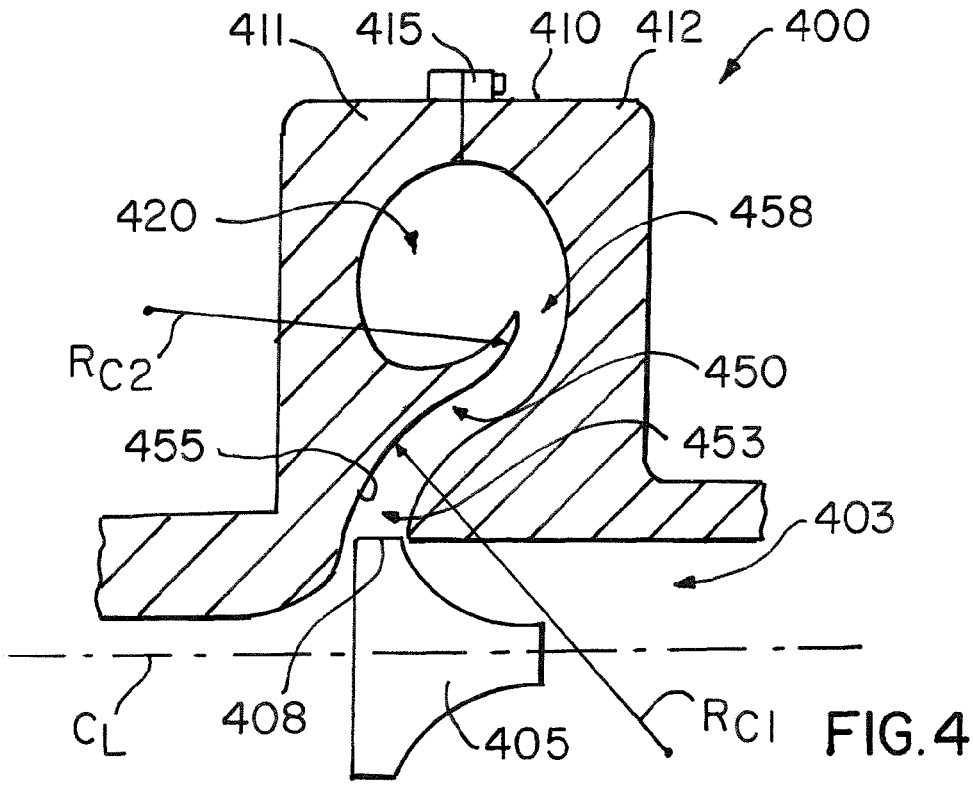
FIG. 4 is a cross-sectional view of a portion of a turbocharger in accordance with an exemplary embodiment of the invention.

Referring to FIG. 4, a turbocharger 400 has a compressor housing 410 connected to center and turbine housings (not shown). The compressor housing 410 has a compressor wheel or impeller 405 rotatably mounted within an impeller chamber 403. The turbocharger 400 has various other features which are not shown in FIG. 4, such as a turbine operatively connected to the engine exhaust manifold, the compressor housing 410 being operatively connected to the engine air intake manifold, and a shaft connecting the turbine impeller and compressor impeller 403 so that rotation of the turbine impeller causes rotation of the compressor impeller. The turbine impeller is driven to rotate by the exhaust gas flowing in the exhaust manifold. The compressor impeller 405 is driven to rotate by the turbine impeller, and, as it rotates, it increases the air mass flow rate, airflow density and air pressure delivered to the engine cylinders. Various other components and configurations can also be used in turbocharger 400.

In the exemplary embodiment of turbocharger 400, the compressor housing 410 has a volute with a scroll 420 and a diffuser 450 for fluid communication between the impeller chamber 403 and the internal combustion engine (not shown). An inlet 453 of the diffuser 450 is preferably in proximity to a tip 408 of the compressor impeller 405. The housing 410 can be formed of multiple portions, such as first and second housings 411 and 412 connected by a connection mechanism 415, for example, one or more bolts. The housing 410 can be formed by various methods including casting, machining and a combination of casting and machining. The housing 410 can be made of various materials including aluminum.

The diffuser 450 can have a curved or otherwise non-linear shape. In one embodiment, the diffuser 250 has a substantially smooth curvature, such as defined by first and second radii of curvature $R_{C1}$ and $R_{C2}$. While the exemplary embodiment of turbocharger 400 has the curvature of diffuser 450 being defined by a pair of radii of curvature $R_{C1}$ and $R_{C2}$, the present disclosure contemplates the diffuser having other curved or non-linear shapes including being defined by a single radius of curvature or more than two radii of curvature. The present disclosure also contemplates one or more portions of the diffuser 450 being straight with the remaining portions being curved to provide a non-linear shape for the diffuser.

The diffuser 450 has an outlet 458 that is connected to the scroll 420. Preferably, inlet 453 is provided with a bend or curved portion 455 that is in proximity to the compressor tip 408. The bend 455 allows for low momentum flow from the compressor impeller 405 to be accelerated to the same or a similar velocity as the reminder of the flow along the bend providing stability to the fluid flow.

The curved or otherwise non-linear diffuser 450 allows for an increase in the length of the diffuser without the need to increase the geometric envelope for the turbocharger 400. The increased length of the diffuser 450 provides for more diffusion and slower diffusion which will increase efficiency and stability in the flow. To reduce losses along the flow path of the diffuser 450, the curvature is preferably smooth without any tight or sharp bends. In one embodiment, the walls of the diffuser 450 are angled, such as converging or diverging, to increase or decrease the rate of diffusion.

Figure 5:
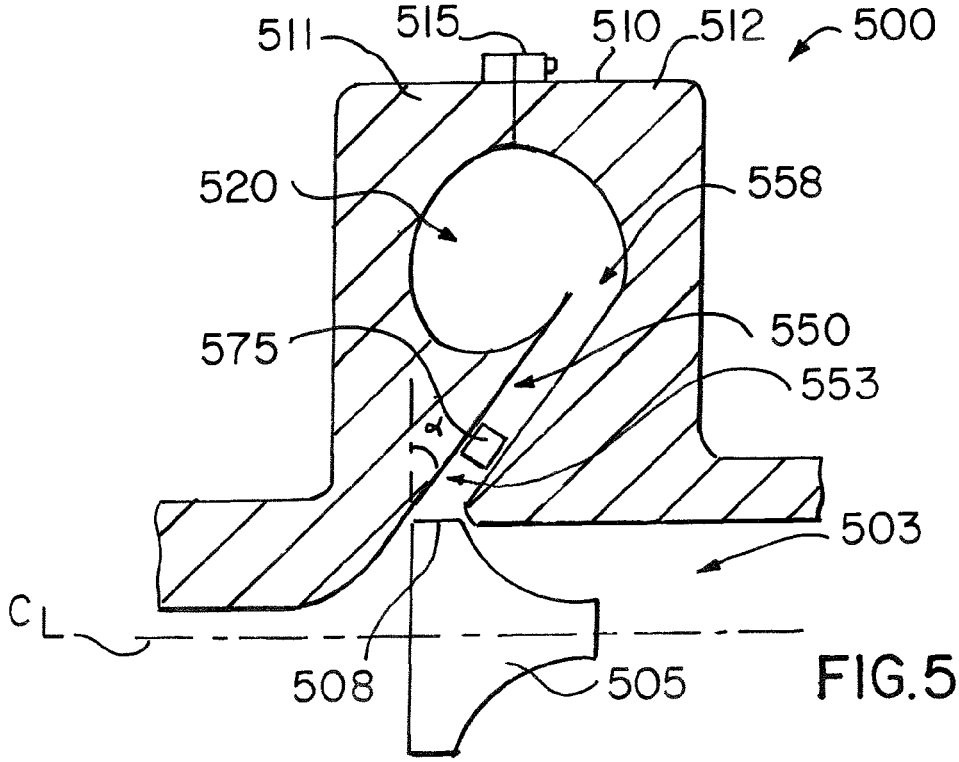
FIG. 5 is a cross-sectional view of a portion of a turbocharger in accordance with another exemplary embodiment of the invention.

Referring to FIG. 5, a turbocharger 500 has a compressor housing 510 with a compressor wheel or impeller 505 rotatably mounted within an impeller chamber 503. Various components and configurations can be used in turbocharger 500, such as those described above with respect to turbocharger 400.

In the exemplary embodiment of turbocharger 500, the compressor housing 510 has a volute with a scroll 520 and a diffuser 550 for fluid communication between the impeller chamber 503 and the internal combustion engine (not shown). An inlet 553 of the diffuser 550 is preferably in proximity to a tip 508 of the compressor impeller 505. The housing 510 can be formed of multiple portions, such as first and second housings 511 and 512 connected by a connection mechanism 515, for example, one or more bolts. The housing 510 can be formed by various methods including casting, machining and a combination of casting and machining. The housing 510 can be made of various materials including aluminum.

The diffuser 550 can have a straight or linear shape which is at a diffuser angle $\alpha$ with respect to the radial axis of the turbocharger 500. In other words, the diffuser 550 can be non-orthogonal to the center line $C_L$ of the turbocharger 500. The particular diffuser angle $\alpha$ can be chosen based on a number of factors including desired length of the diffuser 550, flow efficiency and desired geometric envelope for the turbocharger 500. Diffuser angle $\alpha$ is preferably between about 5 to 75 degrees, more preferably between about 10 to 60 degrees, and most preferably between 20 and 50 degrees. By providing a substantially straight or linear diffuser 550, turbocharger 500 can reduce losses associated with bends, such as due to friction.

The diffuser 550 has an outlet 558 that is connected to the scroll 520. Due to diffuser angle $\alpha$, the inlet 553 is provided with a change of direction or bend that is in proximity to the compressor tip 508. The bend allows for low momentum flow from the compressor impeller 505 to be accelerated to the same or a similar velocity as the reminder of the flow along the bend providing stability to the fluid flow.

The angled or non-orthogonal configuration of diffuser 550 allows for an increase in the length of the diffuser without the need to increase the geometric envelope for the turbocharger 500. The increased length of the diffuser 550 provides for more diffusion and slower diffusion which will increase efficiency. In one embodiment, the walls of the diffuser 550 are angled, such as converging or diverging, to increase or decrease the rate of diffusion.

Diffuser 550 can have one or more vanes 575. The vanes 575 can be fixed or moveable. Where vanes 575 are moveable, appropriate actuating mechanisms and techniques are used. The particular size, shape, and/or configuration of the vanes 575 can be chosen based on a number of factors including efficiency. The present disclosure also contemplates diffuser 550 being vaneless.

Figure 6A:
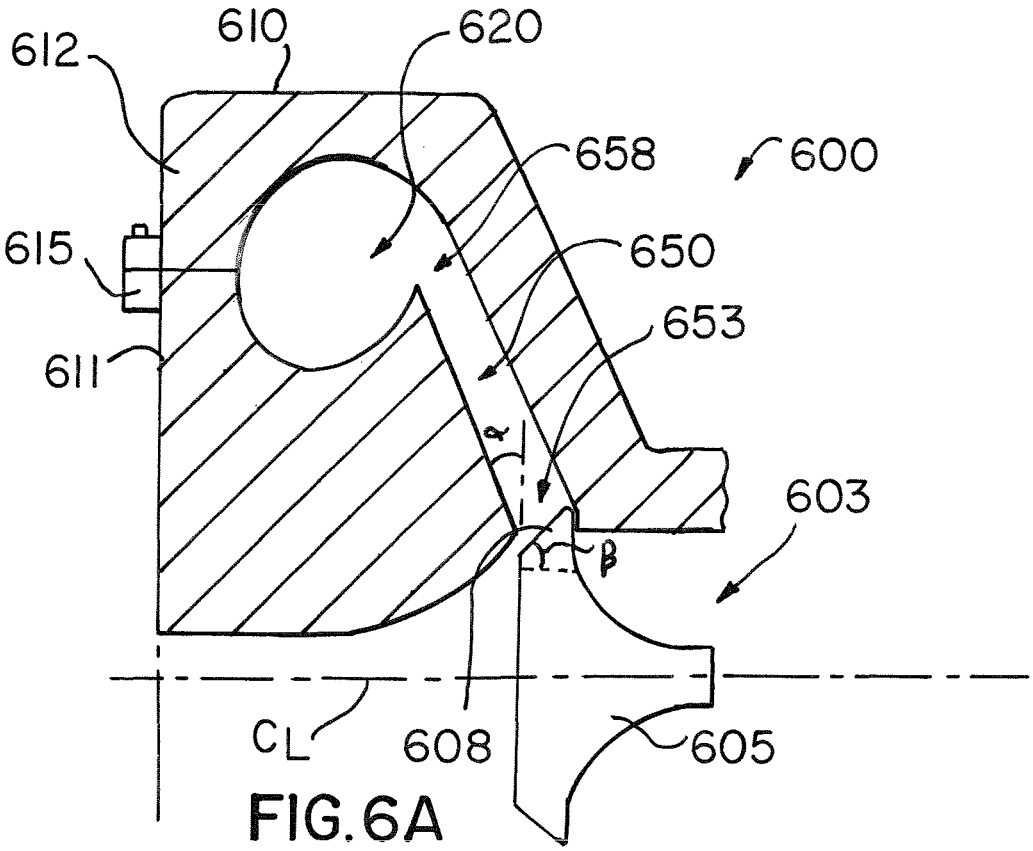
FIG. 6A is a cross-sectional view of a portion of a turbocharger in accordance with another exemplary embodiment of the invention.

Referring to FIG. 6A, a turbocharger 600 has a compressor housing 610 with a compressor wheel or impeller 605 rotatably mounted within an impeller chamber 603. Various components and configurations can be used in turbocharger 600, such as those described above with respect to turbocharger 400.

In the exemplary embodiment of turbocharger 600, the compressor housing 610 has a volute with a scroll 620 and a diffuser 650 for fluid communication between the impeller chamber 603 and the internal combustion engine (not shown). An inlet 653 of the diffuser 650 is preferably in proximity to a tip 608 of the compressor impeller 605. The housing 610 can be formed of multiple portions, such as first and second housings 611 and 612 connected by a connection mechanism 615, for example, one or more bolts. The housing 610 can be formed by various methods including casting, machining and a combination of casting and machining. The housing 610 can be made of various materials including aluminum.

The diffuser 650 can have a straight or linear shape which is at a diffuser angle $\alpha$ a with respect to the radial axis of the turbocharger 600. In other words, the diffuser 650 can be non-orthogonal to the center line CL of the turbocharger 600. The particular diffuser angle $\alpha$ can be chosen based on a number of factors including length of the diffuser 650, flow efficiency and desired geometric envelope of the turbocharger 600. Diffuser angle $\alpha$ is preferably between about 5 to 75 degrees, more preferably between about 10 to 60 degrees, and most preferably between 20 and 50 degrees. By providing a substantially straight or linear diffuser 650, turbocharger 600 can reduce losses associated with bends, such as due to friction.

The embodiment of turbocharger 600 provides a diffuser 650 that extends radially outward in a direction away from the turbine section (not shown), where as the diffuser 550 of turbocharger 500 extends radially outward in a direction towards the turbine section. Turbocharger 500 can take advantage of unused space in the geometric envelope in proximity to the center housing (not shown), while turbocharger 600 can take advantage of unused space in the geometric envelope in proximity to the impeller chamber 603.

The diffuser 650 has an outlet 658 that is connected to the scroll 620. Due to diffuser angle $\alpha$, the inlet 653 is provided with a change of direction or bend that is in proximity to the compressor tip 608. The bend allows for low momentum flow from the compressor impeller 605 to be accelerated to the same or a similar velocity as the reminder of the flow along the bend providing stability to the fluid flow.

The angled configuration of diffuser 650 allows for an increase in the length of the diffuser without the need to increase the geometric envelope for the turbocharger 600. The increased length of the diffuser 650 provides for more diffusion and slower diffusion which will increase efficiency. In one embodiment, the walls of the diffuser 650 are angled, such as converging or diverging, to increase or decrease the rate of diffusion. Impeller 605 can have an extended tip 608 that extends into the inlet 608.

Figure 6C:
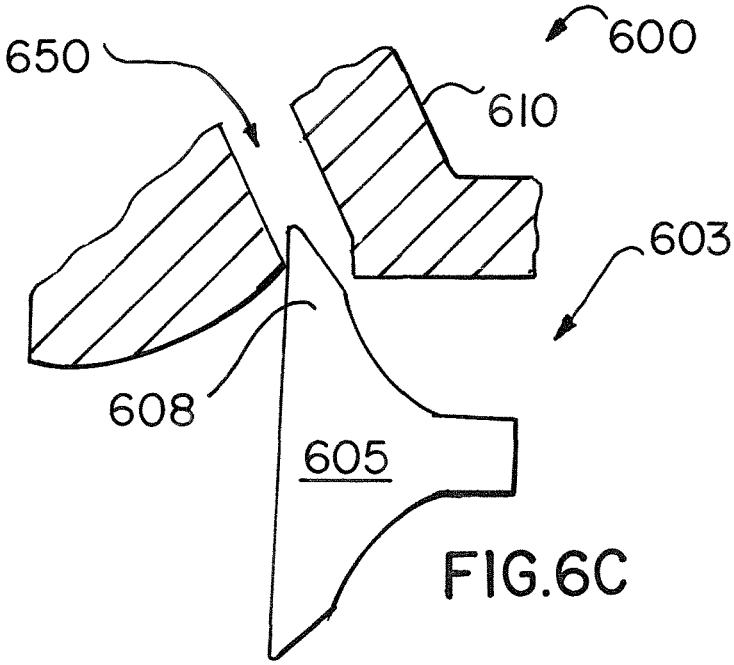
FIG. 6C is an enlarged view of a portion of the turbocharger of FIG. 6 with another alternative compressor tip.
Figure 6B:
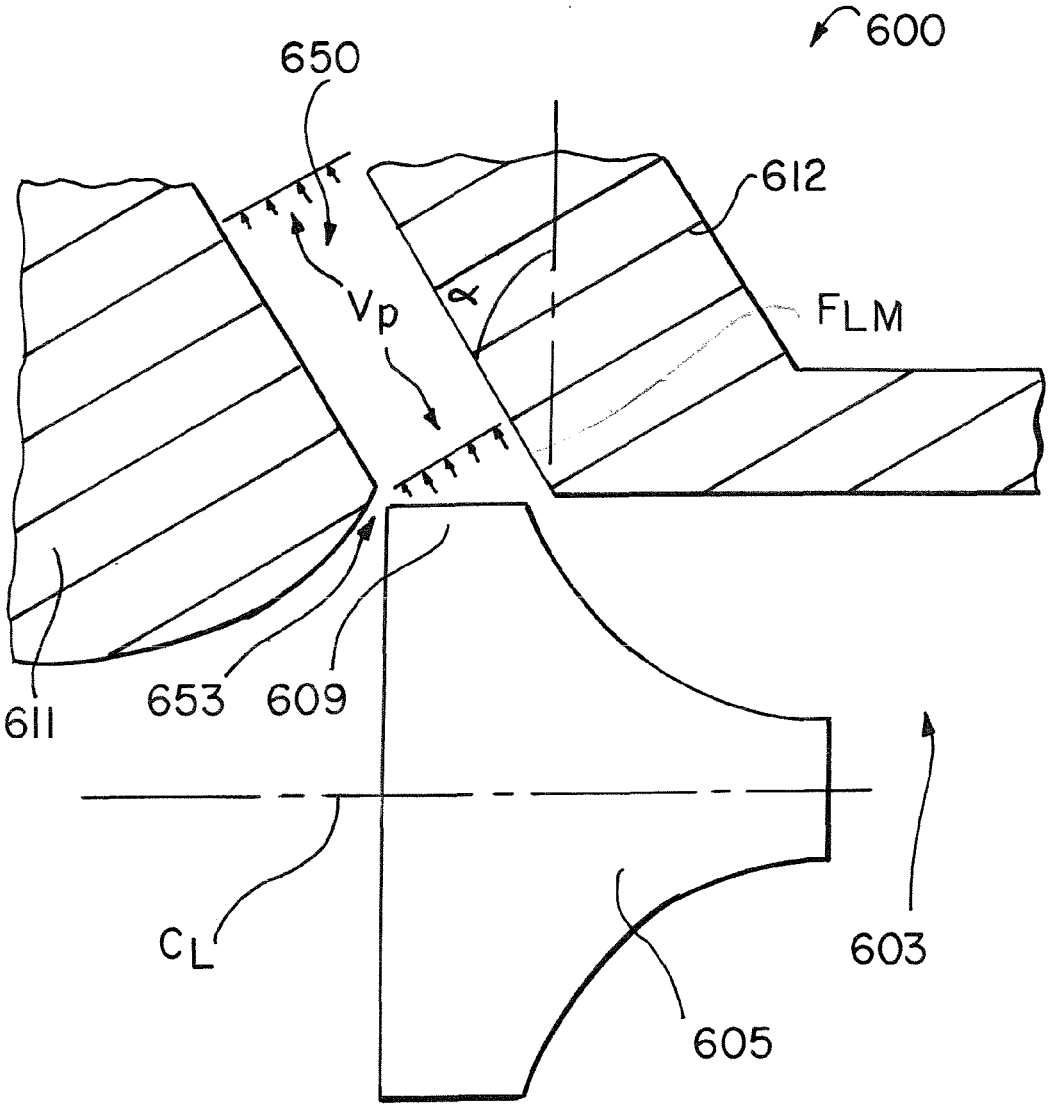
FIG. 6B is an enlarged view of a portion of the turbocharger of FIG. 6 with an alternative compressor tip.

Referring to FIG. 6B, an enlarged portion of turbocharger 600 is shown with an axially flat or non-extended tip 609. The impeller 605 provides fluid entering the diffuser 650 with a non-uniform velocity profile $V_P$. The diffuser angle $\alpha$ and the bend or change of direction in proximity to the inlet 653 allow for low momentum flow $F_{LM}$ from the compressor impeller 605 to be accelerated to the same or a similar velocity as the reminder of the flow along the bend. In one embodiment, diffuser 650 is provided with a bend, change of direction or other curvature immediately downstream of the impeller tip 609 to accelerate the low momentum flow $F_{LM}$ to substantially the same velocity as the remainder of the flow and stabilize flow. Downstream of the rotor tip 609, the velocity profile $V_P$ is more uniform. In one embodiment, the angle $\beta$ can be changed to influence the velocity profile. Changing the angle $\beta$ can decrease the work or energy required to turn the flow. Referring to FIG. 6C, an enlarged portion of turbocharger 600 is shown with another axially flat or non-extended tip 609.

In one embodiment, a method of manufacturing turbochargers 400, 500 and 600 includes determining whether the fluid flow has a uniform or non-uniform velocity profile $V_P$ at the inlet of the diffuser. If a non-uniform velocity profile $V_P$ exists, then a bend or curvature is formed in the diffuser in proximity to the diffuser inlet and preferably immediately downstream of the inlet. The degree or extent of the bend or curvature (e.g., the diffuser angle $\alpha$ or the radius of curvature) is chosen based on the non-uniform velocity profile $V_P$. For example, a small diffuser angle $\alpha$ may be used with turbocharger 600 if it is determined that there is only a small amount of non-uniformity in the velocity profile $V_P$ such that the low momentum flow $F_{Lm}$ only requires a small amount of diffuser length in order to be accelerated to substantially the same velocity as the remainder of the flow. A correlation between the adjustment to the non-uniform velocity profile $V_P$ and the degree or extent of the diffuser bend or curvature in proximity to the inlet can be determined. However, the present disclosure also contemplates the extent of the non-uniformity in the velocity profile $V_P$ being one of several factors that are considered in determining the degree or extent of the bend or curvature.

Figure 7:
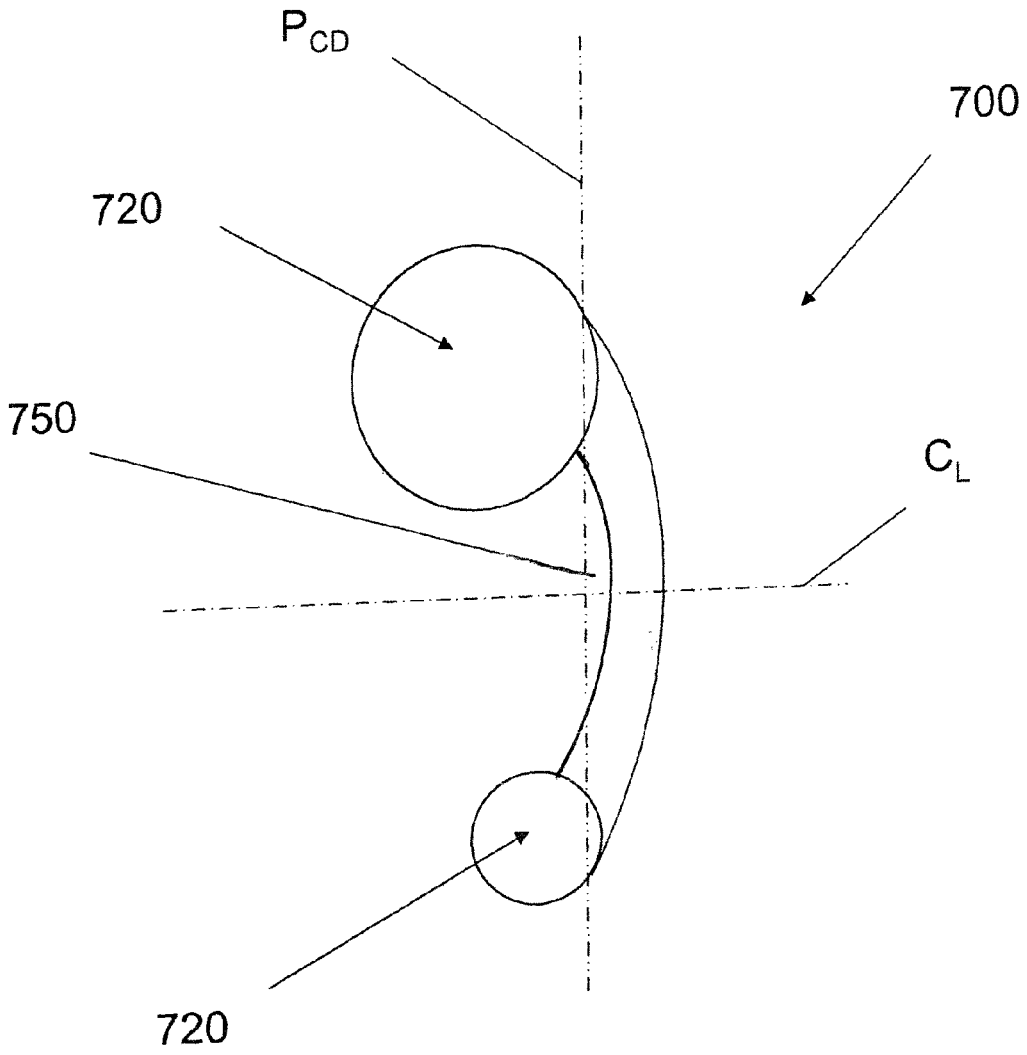
FIG. 7 is a schematic cross-sectional representation of a turbocharger housing in accordance with an exemplary embodiment of the invention.

Referring to FIG. 7, a portion of a compressor housing 700 is shown having a scroll 720 and a diffuser 750. Diffuser 750 lies along diffuser plane $P_{CD}$ which intersects the scroll 720. The diffuser 750 has a uniformly curved shape defined by a single radius of curvature $R_C$. The use of the uniformly curved diffuser 750 allows for a larger length of the diffuser without the need to increase the geometric envelope for the turbocharger. The longer diffuser length provides the advantages described above with respect to turbochargers 400, 500 and 600.

Figure 8:
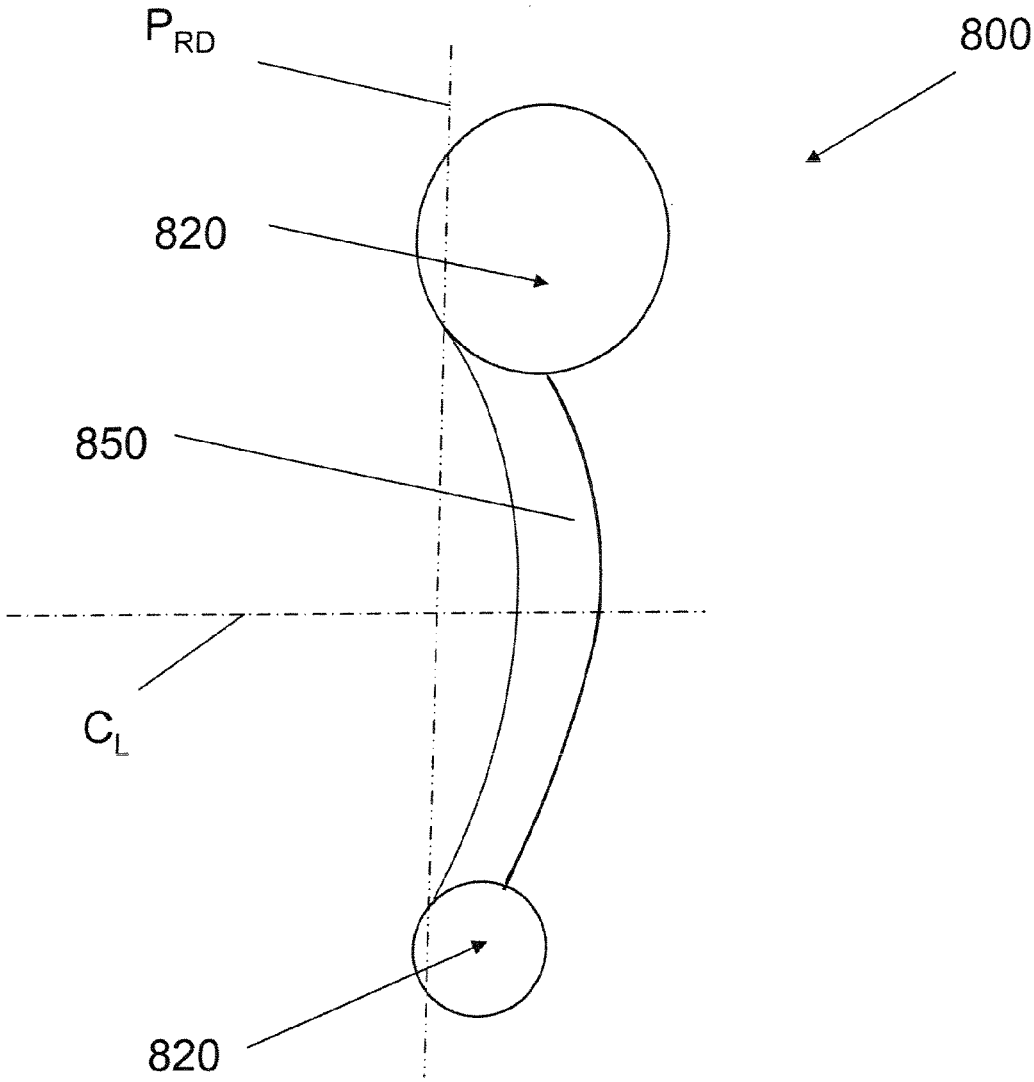
FIG. 8 is a schematic cross-sectional representation of a turbocharger housing in accordance with another exemplary embodiment of the invention.

Referring to FIG. 8, a portion of a compressor housing 800 is shown having a scroll 820 and a diffuser 850. Diffuser 850 lies along diffuser plane $P_{RD}$ which intersects the scroll 820. The diffuser 850 preferably has a uniformly curved shape defined by a single radius of curvature $R_C$. The use of the curved diffuser 850 allows for a larger length of the diffuser without the need to increase the geometric envelope for the turbocharger. The longer diffuser length provides the advantages described above with respect to turbochargers 400, 500 and 600.

Housing 800 positions the scroll 820 outside of the curved diffuser 850 and reverses the direction of the flow after it enters the scroll 820, while maintaining substantially the same geometric envelope for the turbocharger. Where the curve of diffuser 850 subtends an arc of 90 degrees, the diffuser plane $P_{RD}$ can bisect or pass through the center of the scroll 820. In one embodiment, the walls can diverge to increase the cross-sectional area, such as when the diffuser 850 turns axially.

Figure 9:
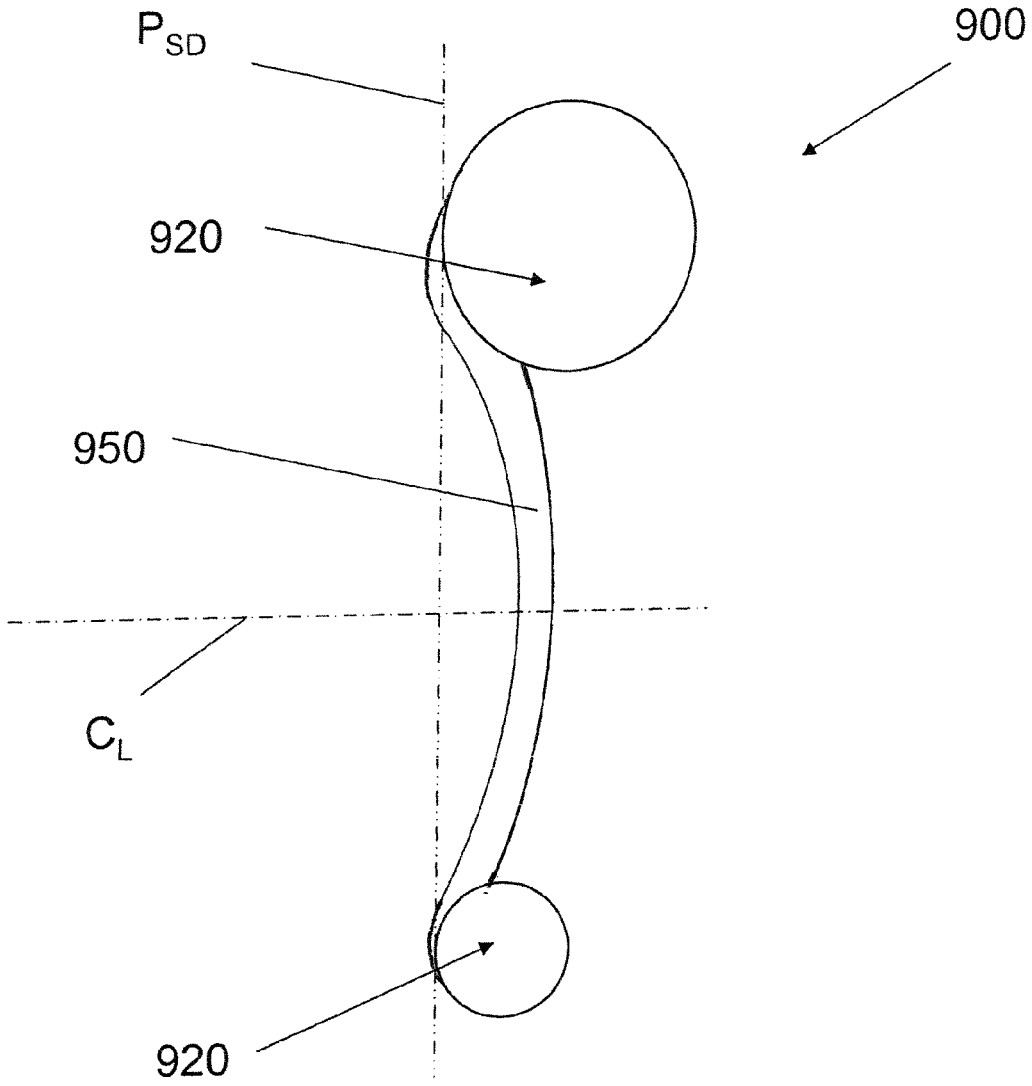
FIG. 9 is a schematic cross-sectional representation of a turbocharger housing in accordance with another exemplary embodiment of the invention.

Referring to FIG. 9, a portion of a compressor housing 900 is shown having a scroll 920 and a diffuser 950. Diffuser 950 lies along diffuser plane $P_{SD}$ which is tangential to the scroll 920. The diffuser 950 preferably has a uniformly curved shape along a middle portion thereof defined by the single radius of curvature $R_C$. The use of the curved diffuser 950 allows for a larger length of the diffuser without the need to increase the geometric envelope for the turbocharger. The longer diffuser length provides the advantages described above with respect to turbochargers 400, 500 and 600.

Housing 900 increases the angle through which the diffuser 950 progresses before the entrance to the scroll 920. The direction of the flow is reversed while still in the diffuser 950 and the diffuser length is increased.

The exemplary embodiments produce a higher pressure ratio using substantially the same geometric envelope as the contemporary compressor housing. The exemplary embodiments also allow for flexibility in the positioning of the scrolls and/or diffusers with respect to the other components of the turbocharger, which is advantageous in smaller engine compartments where space is at a premium. The diffusers described herein can be vaneless or vaned, including fixed or moveable vanes.

Figure 1:
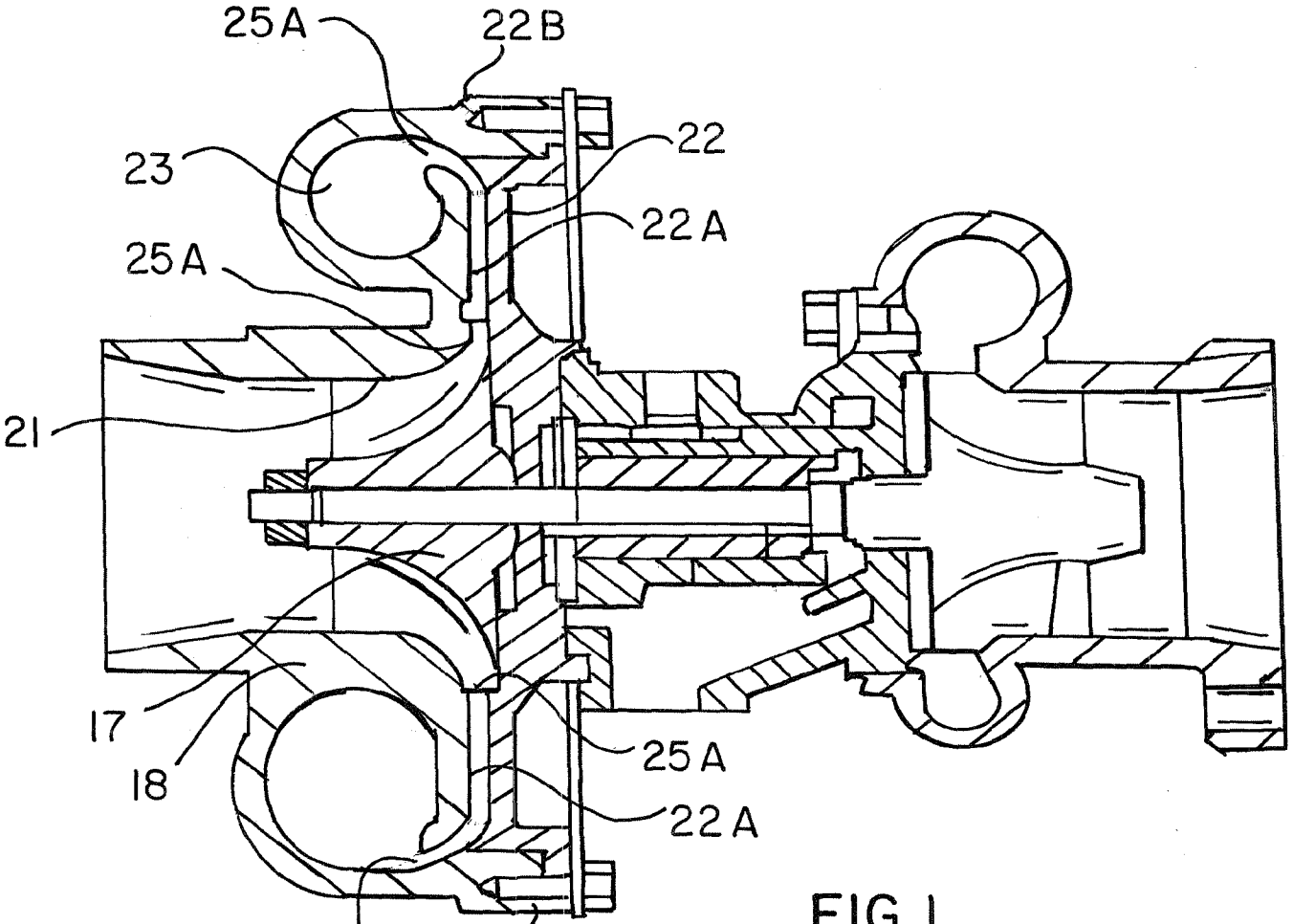
FIG. 1 (PRIOR ART)
FIG. 1 is a schematic representation of a contemporary turbocharger system with a diffuser.
Figure 2:
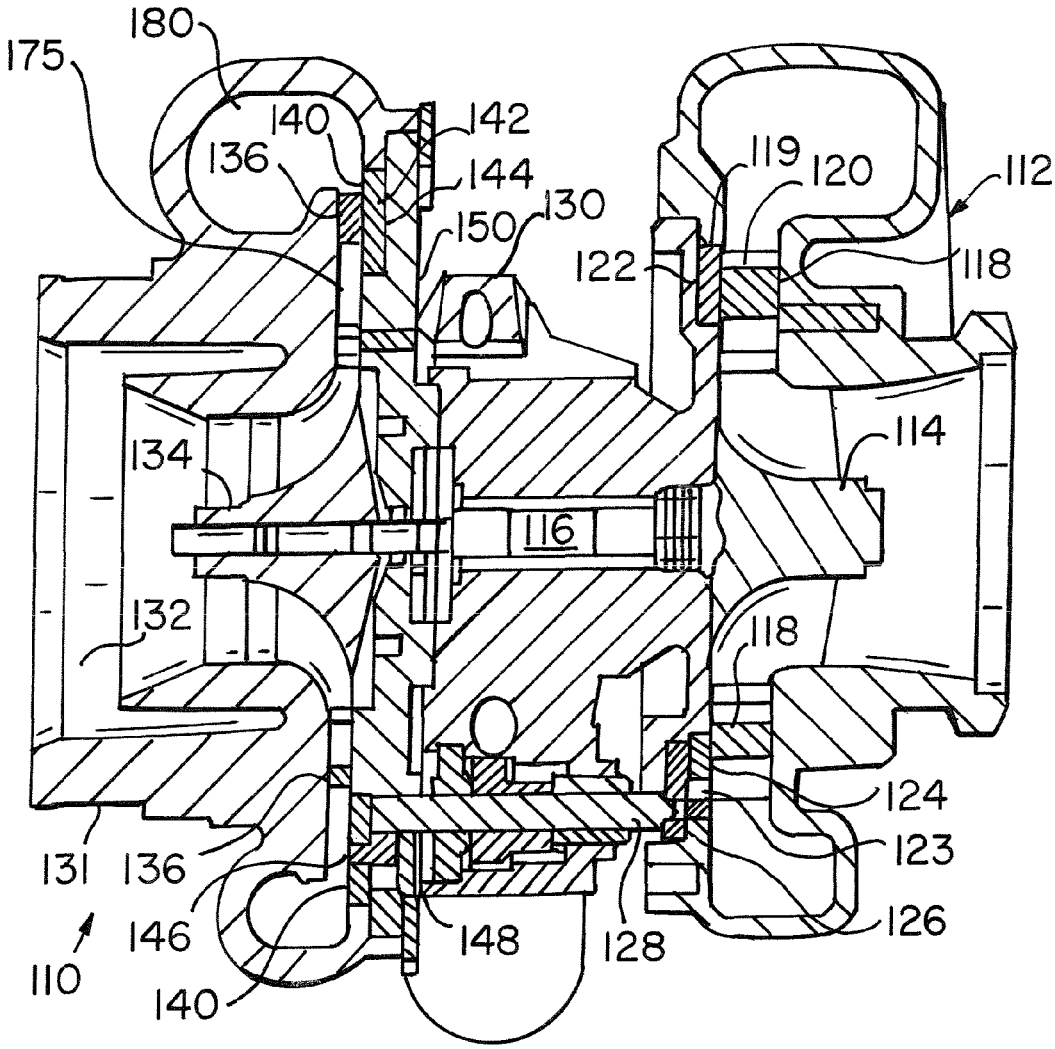
FIG. 2 (PRIOR ART)
FIG. 2 is a schematic representation of another contemporary turbocharger system with a diffuser.
Figure 3:
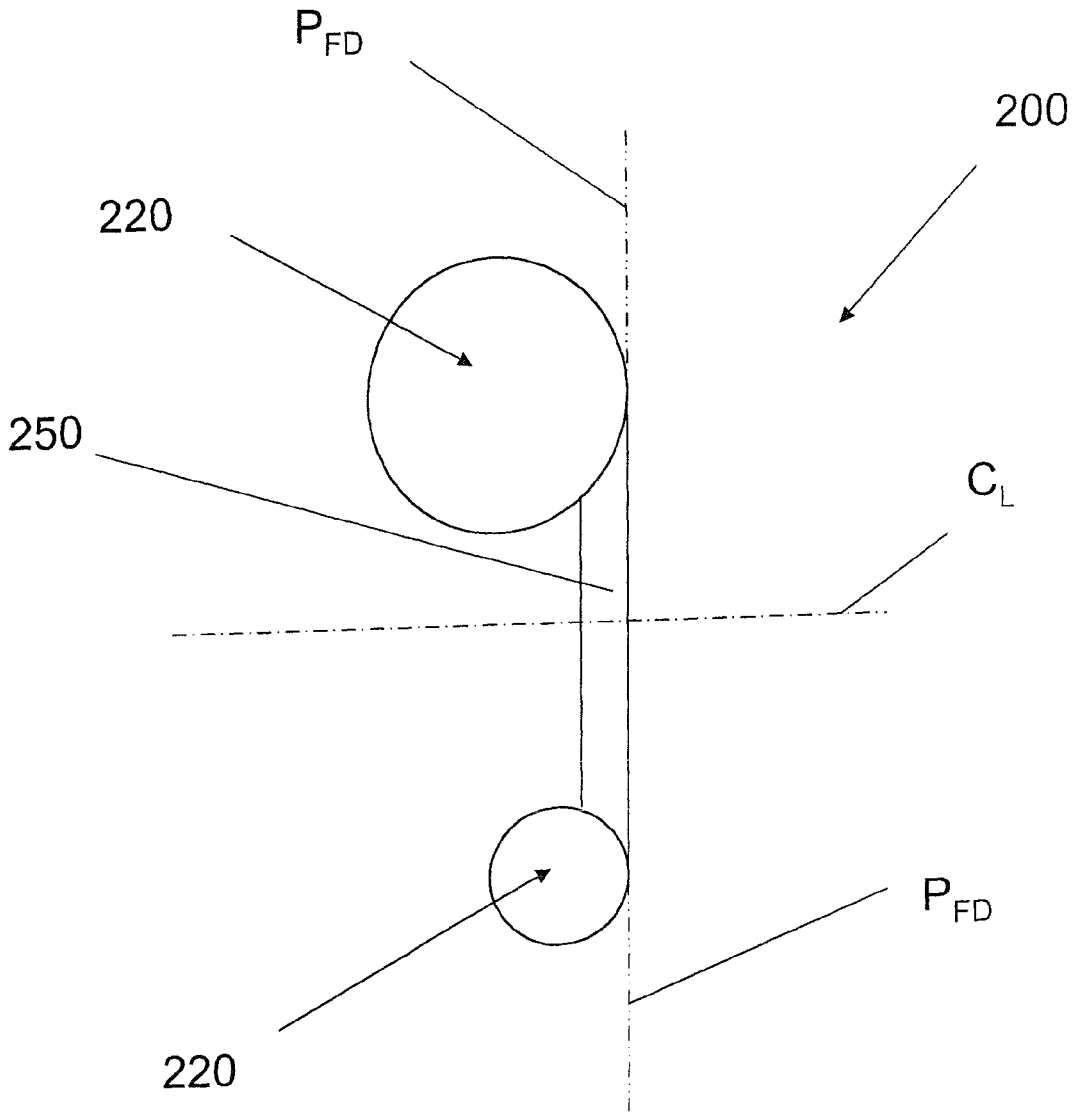
FIG. 3 (PRIOR ART)
FIG. 3 is a schematic cross-sectional representation of a contemporary radial flat diffuser.
Figure 10:
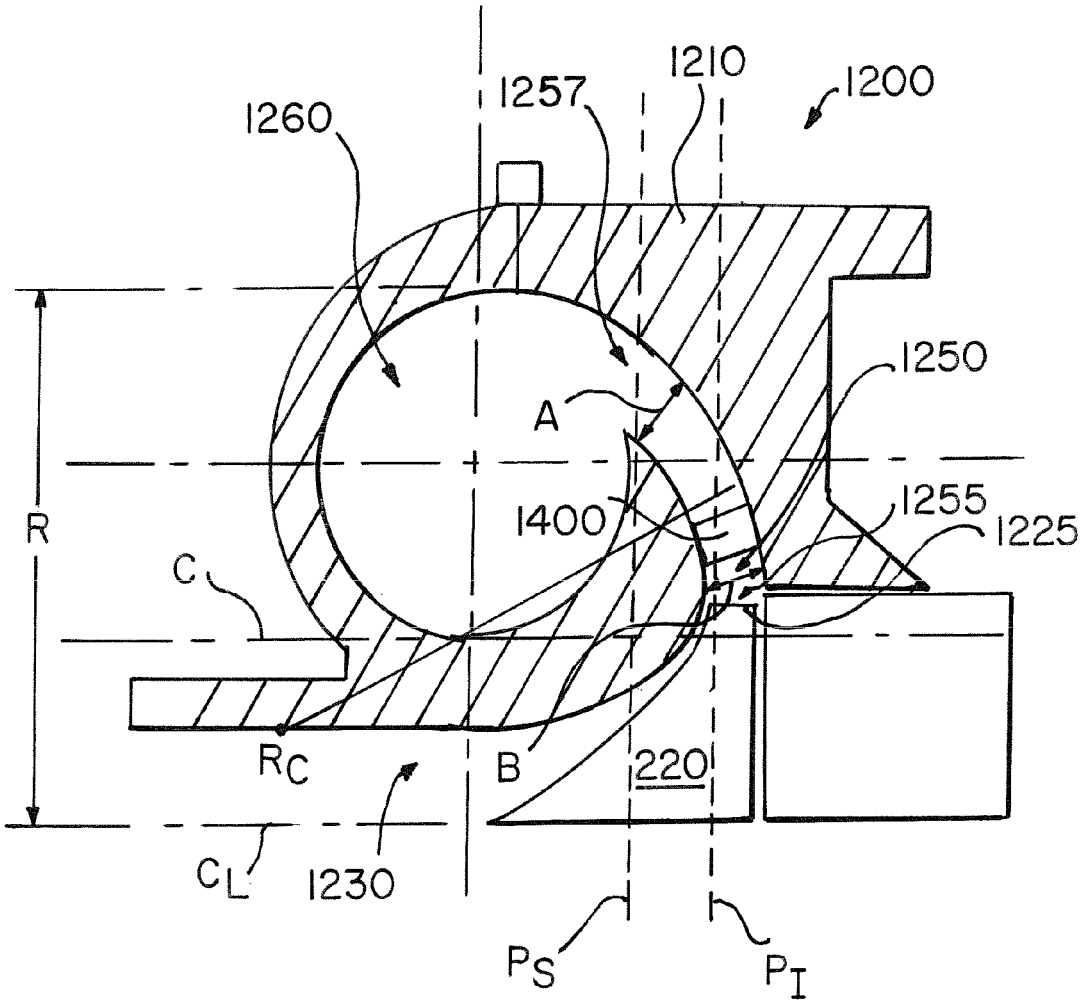
FIG. 10 is a cross-sectional view of a portion of a turbocharger in accordance with an exemplary embodiment of the invention.

Referring to FIG. 10, a turbocharger 1200 has a compressor housing 1210 connected to center and turbine housings (not shown). The compressor housing 1210 has a compressor wheel or impeller 1220 rotatably mounted within an impeller chamber 1230. The turbocharger 1200 has various other features which are not shown in FIG. 3, such as a turbine operatively connected to the engine exhaust manifold, the compressor housing 1210 being operatively connected to the engine air intake manifold, and a shaft connecting the turbine impeller and compressor impeller 1220 so that rotation of the turbine impeller causes rotation of the compressor impeller. The turbine impeller is driven to rotate by the exhaust gas flowing in the exhaust manifold. The compressor impeller 1220 is driven to rotate by the turbine impeller, and, as it rotates, it increases the air mass flow rate, airflow density and air pressure delivered to the engine cylinders. Various other components and configurations can also be used in turbocharger 1200.

In the exemplary embodiment of turbocharger 1200, the compressor housing 1210 has a volute with a diffuser 1250 and a scroll 1260 for fluid communication between the impeller chamber 1230 and the internal combustion engine (not shown). An inlet 1255 of the diffuser 1250 is preferably in proximity to a tip 1225 of the compressor impeller 1220. The housing 1210 can be a single body or multiple portions, and can be formed by various methods including casting, machining and a combination of casting and machining. The housing 1210 can be made of various materials including aluminum.

The diffuser 1250 can have a curved or otherwise non-linear shape or path. In one embodiment, the diffuser 1250 has a substantially uniform curvature, such as defined by a single radius of curvature $R_C$. The radius of curvature $R_C$ is preferably between about 1 to 1000 inches. In another embodiment, the diffuser 1250 can include one or more guide vanes 1400. The guide vanes 1400 can be fixed, moveable or a combination of both.

While the exemplary embodiment of turbocharger 1200 shows the curvature of diffuser 1250 being defined by a single radius of curvature $R_C$, the present disclosure contemplates the diffuser having other curved or non-linear shapes including being defined by a plurality of radii of curvature. The present disclosure also contemplates one or more portions of the diffuser 1250 being straight with the remaining portions being curved to provide a non-linear shape for the diffuser.

The diffuser 1250 has an outlet 1257 that is preferably connected to the scroll 1260 along a radially outer portion (as measured from a centerline $C_L$ of the turbocharger) of the scroll. Preferably, the inlet 1255 of the diffuser 1250 is radially outward (as measured from the centerline $C_L$ of the turbocharger) of the inner circumference of scroll 260 as shown by reference line C. Where the tip 1225 of the compressor impeller 1220 is in proximity to the diffuser inlet 1255, the tip is also positioned radially outward of the inner circumference of the scroll 1260.

The use of a curved or otherwise non-linear diffuser 1250 allows for a smaller geometric envelope for the turbocharger 1200 without sacrificing the length of the diffuser. As can be seen in FIG. 10, the outer radius R, or the outer diameter, of the scroll 1260 can be reduced to provide for the smaller geometric envelope or package while maintaining the length over which the flow from the impeller 1220 is permitted to diffuse.

The inlet 1255 of the diffuser 1250 is preferably axially remote from the diffuser 1260 as shown by the separation of the scroll plane $P_S$ and the inlet plane $P_I$. By moving the scroll 1260 closer to the impeller chamber 1230 but axially remote from the inlet 1255 of the diffuser 1250 and/or from the impeller 1220, the turbocharger 1200 reduces the radial geometry of the envelope through utilization of unused space in the envelope in an axial direction away from the impeller. There is a greater amount of divergence in the region shown by arrow A as compared to the region shown by arrow B. In one embodiment, the curvature of the diffuser path is defined by a plurality of radii which can provide more diffusion as compared to a path defined by a single radius of curvature.

Figure 11:
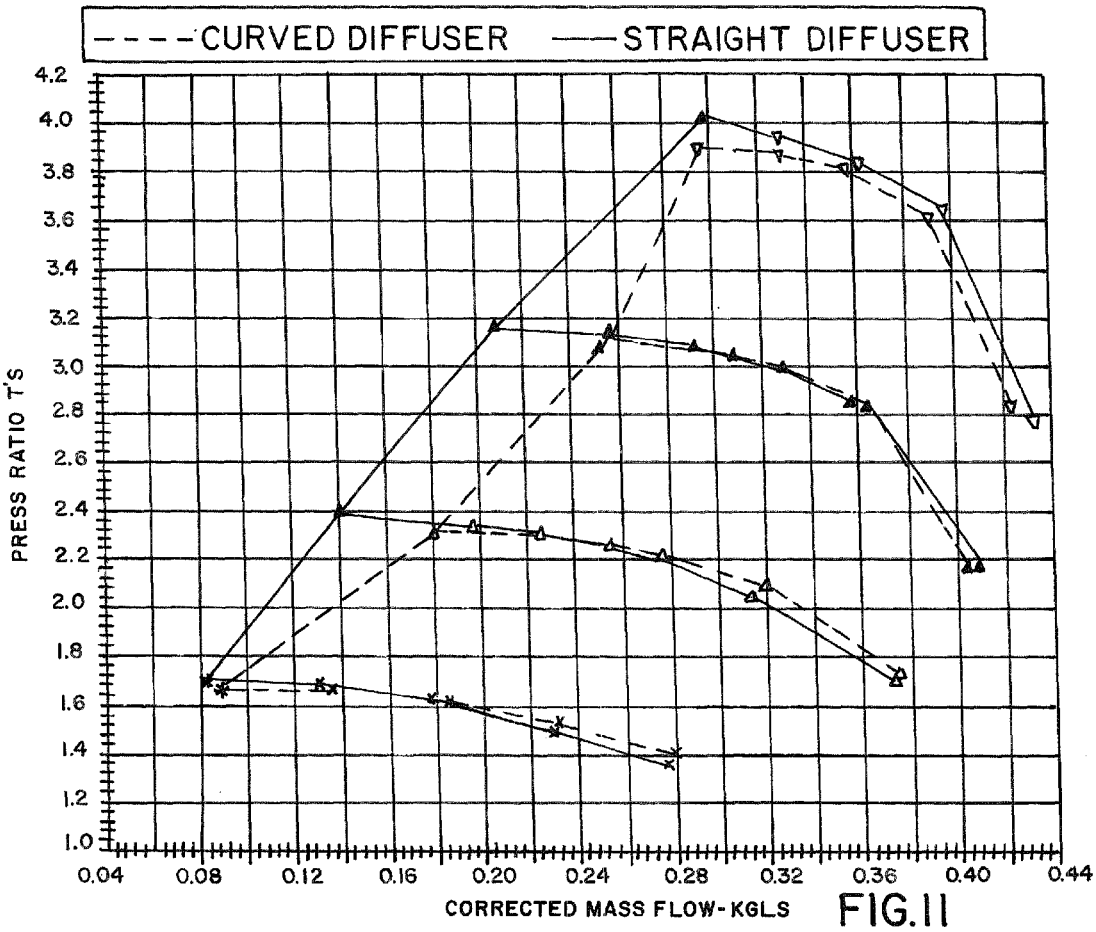
FIG. 11 is a graphical representation of performance data comparing the turbocharger of FIG. 3 with a contemporary turbocharger having a straight diffuser.
Figure 12:
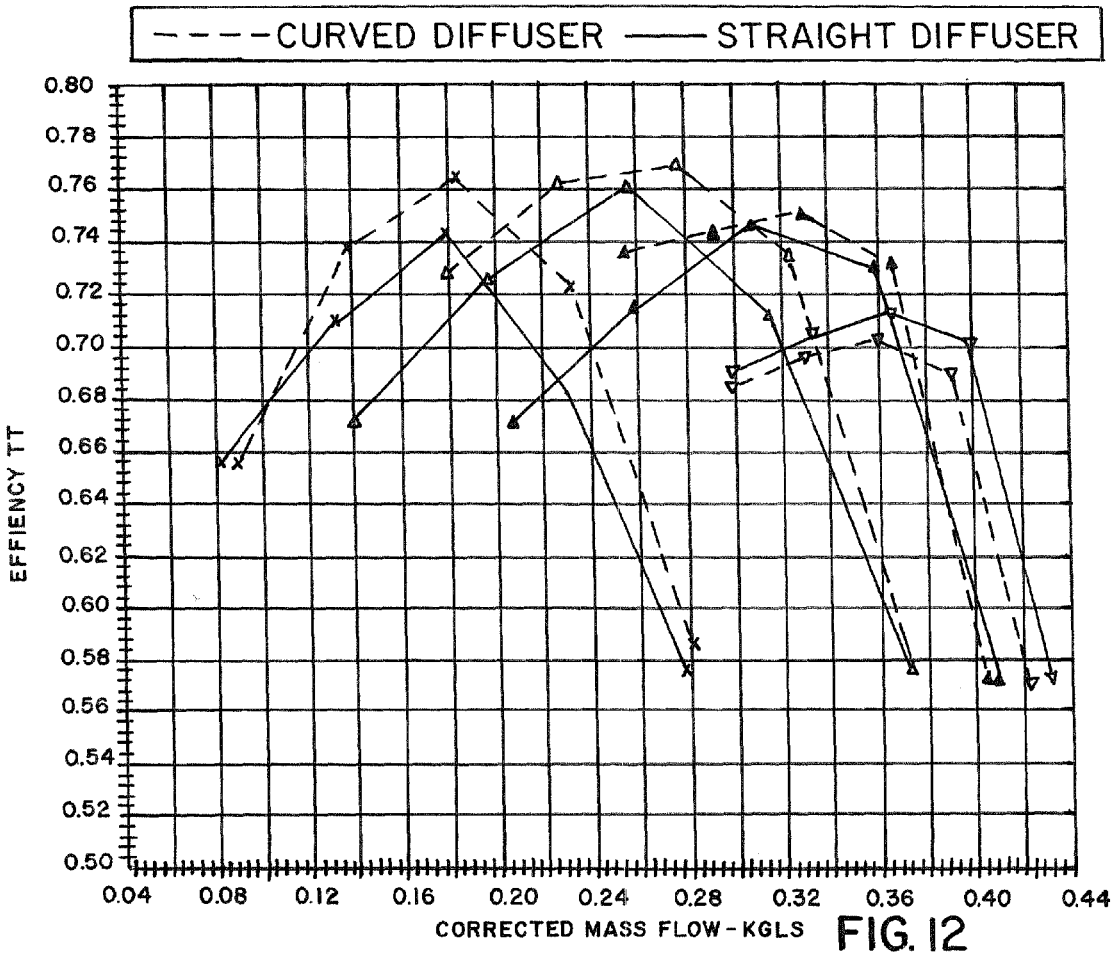
FIG. 12 is another graphical representation of performance data comparing the turbocharger of FIG. 10 with a contemporary turbocharger having a straight diffuser.

Referring to FIG. 11, the performance of turbocharger 1200 having the curved diffuser 1250 and scroll 1260 was compared to a contemporary turbocharger having a radially flat or straight diffuser. The curved diffuser 1250 did not have any guide vanes. Turbocharger 1200 had a scroll outer diameter that was 0.53 inches smaller than the scroll outer diameter of the contemporary turbocharger having a radially flat or straight diffuser. In a comparison of the pressure ratio with mass flow rates, it was found that the pressure ratio performance of turbocharger 1200 was within acceptable limits as compared to the contemporary turbocharger over various speed lines.

Referring to FIG. 5, the performance of turbocharger 1200 having the curved diffuser 1260 and scroll 1260 was again compared to a contemporary turbocharger having a radially flat or straight diffuser. The curved diffuser 1250 did not have any guide vanes. Turbocharger 1200 had a scroll outer diameter that was 0.53 inches smaller than the scroll outer diameter of the contemporary turbocharger having a radially flat or straight diffuser. In a comparison of the efficiency with mass flow rates, it was found that the efficiency performance of turbocharger 1200 was within acceptable limits as compared to the contemporary turbocharger over various speed lines, and exceeded the efficiency of the contemporary turbocharger for a majority of the speed lines.

While the exemplary embodiment has been described with respect to a compressor of a turbocharger, it should be understood that the present disclosure contemplates the use of the exemplary embodiments with a turbine of the turbocharger. The exemplary embodiment can also be used with variable geometry guide vanes in either or both of the turbine and compressor sections, as well as other types of turbochargers including fixed vane turbochargers. It is also contemplated by the present disclosure that the features of the turbochargers and/or housings can be used with other types of fluid impelling devices where a particular length of a diffuser is desired. Such other fluid impelling devices include, but are not limited to, the following: superchargers; centrifugal pumps; centrifugal fans; single-stage gas compressors; multistage gas compressors; and other kinds of devices which generally use one or more rotating elements to compress gases and/or induce fluid flow.

While the invention has been described by reference to a specific embodiment chosen for purposes of illustration, it should be apparent that numerous modifications could be made thereto by those skilled in the art without departing from the spirit and scope of the invention.

What is claimed is:

1. A compressor housing (410, 510, 610, 700, 800, 900) for a turbocharger (400, 500, 600) having an impeller (405, 505, 605) mounted for rotation about an axis and shaped for drawing air in axially and discharging air radially, the housing (410, 510, 610, 700, 800, 900) comprising:

an impeller chamber (403, 503, 603) rotatably housing the impeller (405, 505, 605);

a scroll (420, 520, 620, 720, 820, 920); and a diffuser (450, 550, 650, 750, 850, 950) having an inlet (453, 553, 653) in proximity to the impeller (405, 505, 605) for receiving air discharged radially by said impeller and an outlet (458, 558, 658) connected to the scroll (420, 520, 620, 720, 820, 920), wherein the impeller chamber (403, 503, 603), diffuser (450, 550, 650, 750, 850, 950) and scroll (420, 520, 620, 720, 820, 920) are in fluid communication, and wherein the diffuser (450, 550, 650, 750, 850, 950) has a bend (455).

2. The housing (410, 510, 610, 700, 800, 900) of claim 1, wherein the inlet (453, 553, 653) has a bend (455).

3. The housing (410, 510, 610, 700, 800, 900) of claim 1, wherein the diffuser (750, 850) is defined by a single radius of curvature (RC).

4. A compressor 410, 510, 610, 700, 800, 900) for a turbocharger (400, 500, 600) having an impeller (405, 505, 605) mounted for rotation about an axis and shaped for drawing air in axially and discharging air radially, the housing (410, 510, 610, 700, 800, 900) comprising:

an impeller chamber (403, 503, 603) rotatably housing the impeller (405, 505, 605);

a scroll (420, 520, 620, 720, 820, 920); and a diffuser (450, 550, 650, 750, 850, 950) having an inlet (453, 553, 653) in proximity to the impeller (405, 505, 605) for receiving air discharged radially by said impeller and an outlet (458, 558, 658) connected to the scroll (420, 520, 620, 720, 820, 920), wherein the impeller chamber (403, 503, 603), diffuser (450, 550, 650, 750, 850, 950) and scroll (420, 520, 620, 720, 820, 920) are in fluid communication, and wherein the diffuser (450, 550, 650, 750, 850, 950) has a bend (455)

wherein the diffuser (450, 950) is defined by a plurality of radii of curvature (RC1, RC2).

5. The housing (410, 510, 610, 700, 800, 900) of claim 1, wherein the diffuser (450, 550, 650, 750, 850, 950) lies in a diffuser plane, and wherein the diffuser plane intersects the scroll (720, 820).

6. The housing (410, 510, 610, 700, 800, 900) of claim 1, wherein the diffuser (450, 550, 650, 750, 850, 950) lies in a diffuser plane, and wherein the diffuser plane bisects the scroll.

7. The housing (410, 510, 610, 700, 800, 900) of claim 1, wherein the diffuser (450, 550, 650, 750, 850, 950) lies in a diffuser plane, and wherein the diffuser plane is tangential to the scroll (920).

8. The housing (410, 510, 610, 700, 800, 900) of claim 1, wherein the diffuser is defined by a single radius of curvature (RC), and wherein the single radius of curvature (RC) is between 1 to 1000 inches.

9. A turbocharger (400, 500, 600) comprising:

an impeller (405, 505, 605) mounted for rotation about an axis and shaped for drawing air in axially and discharging air radially; and a housing (410, 510, 610, 700, 800, 900) defining an impeller chamber (403, 503, 603), a diffuser (450, 550, 650, 750, 850, 950) and a scroll (420, 520, 620, 720, 820, 920), wherein the impeller (405, 505, 605) is rotatably mounted in the housing (410, 510, 610, 700, 800, 900), wherein the impeller chamber (403, 503, 603), diffuser (450, 550, 650, 750, 850, 950) and scroll (420, 520, 620, 720, 820, 920) are in fluid communication, and wherein the diffuser (450, 550, 650, 750, 850, 950) receives air discharged radially by said impeller and extends in a radial direction that is non-orthogonal to a center line of the turbocharger (400, 500, 600).

10. The turbocharger (400, 500, 600) of claim 8, wherein the diffuser (550, 650) has a linear shape.

11. The turbocharger (400, 500, 600) of claim 8, further comprising one or more vanes (575) positioned in the diffuser (450, 550, 650, 750, 850, 950).

* * * * *

UNITED STATES PATENT AND TRADEMARK OFFICE

CERTIFICATE OF CORRECTION

PATENT NO. : 8,632,304 B2
APPLICATION NO. : 12/664201
DATED : January 21, 2014
INVENTOR(S) : Sweetland et al.

It is certified that error appears in the above-identified patent and that said Letters Patent is hereby corrected as shown below:

Title page, change the Assignee (item 73) from BorgWarner to BorgWarner Inc.

Signed and Sealed this
Fourth Day of November, 2014

Michelle K. Lee

Michelle K. Lee
*Deputy Director of the United States Patent and Trademark Office*